US006077118A

United States Patent [19]

Harada et al.

[11] Patent Number: 6,077,118

[45] Date of Patent: Jun. 20, 2000

[54] ELECTRICAL CONNECTOR HAVING A METAL SHELL

[75] Inventors: Ken Harada, Inagi; Ryouji Hirabayashi, Shiojiri; Naotoshi Ito, Tokyo; Shigetoshi Yamaguchi, Isehara, all of Japan

[73] Assignee: Molex Incorporated, Lisle, Ill.

[21] Appl. No.: 09/013,619

[22] Filed: Jan. 26, 1998

[30] Foreign Application Priority Data

Feb. 21, 1997 [JP] Japan ..... 9-053924

[51] Int. Cl.[7] ..... H01R 13/648; H01R 9/03

[52] U.S. Cl. ..... 439/607; 439/610

[58] Field of Search ..... 439/607, 610; 174/35; 24/324, 459, 663

[56] References Cited

U.S. PATENT DOCUMENTS

| | | | |
|---|---|---|---|
| 4,857,668 | 8/1989 | Buonanno | 174/35 |
| 5,017,158 | 5/1991 | Liu et al. | 439/609 |
| 5,028,740 | 7/1991 | Tomiya | 174/35 |
| 5,124,888 | 6/1992 | Suzuki et al. | 361/395 |
| 5,281,169 | 1/1994 | Kiat et al. | 439/607 |
| 5,532,427 | 7/1996 | Stoyko | 174/35 R |
| 5,801,335 | 9/1998 | Brussali et al. | 174/138 |

FOREIGN PATENT DOCUMENTS 0427 630 B1 5/1991 European Pat. Off. ..... H01R 13/658

OTHER PUBLICATIONS

Mechanical Engineer's Handbook, Edited by Myer Kutz, John Wiley & Sons, Inc. pp. 621–622, 1986.

*Primary Examiner*—Lincoln Donovan
*Assistant Examiner*—Chandrika Prasad
*Attorney, Agent, or Firm*—Stephen Z. Weiss

[57] ABSTRACT

An electrical connector includes an insulative housing, with a plurality of terminals mounted in the housing. A metal shell is disposed about at least a portion of the housing. The shell has a given thickness and opposed ends forming a joint. The opposed ends are overlapped at the joint. Each overlapped end has a reduced thickness less than the given thickness of the metal shell. Preferably, the combined thickness of the overlapped ends is substantially equal to the given thickness of the metal shell.

17 Claims, 5 Drawing Sheets

ELECTRICAL CONNECTOR HAVING A METAL SHELL

FIELD OF THE INVENTION

The present invention generally relates to the art of electrical connectors and, particularly, to an improved joint in a metal shell for a shielded electrical connector.

BACKGROUND OF THE INVENTION

In many electrical connector applications, external electrical "noise" may penetrate into the signal lines extending through the electrical connector by electromagnetic induction. Conversely, electrical noise may radiate out of the connector from the signal lines to other electrical equipment by electromagnetic radiation. Such "noise" is referred to as electromagnetic interference (EMI).

In order to eliminate or significantly reduce EMI, electrical connectors often are provided with a shield which surrounds the electrical connector at least about the signal line termination area thereof. A typical shield is a metal shell which often is stamped and formed of sheet metal material. The metal shell provides a covering about the outer periphery of an insulative housing in which a plurality of terminals are mounted. For instance, the sheet metal shell may be in the form of a quadrangular tube shaped configuration, with a front opening to expose a front mating end of the housing, and a rear opening from which tail portions of the terminals extend. Most often, the sheet metal shell has opposed ends forming a joint, and the opposed ends often are overlapped at the joint.

One of the problems in simply overlapping opposed ends of a metal shell to form a joint, is that a gap often is formed between the opposed ends. The gap not only allows for EMI leakage, but the gap allows for penetration of environmental gases and/or dust to enter the connector. If the connector is to be mounted on a printed circuit board, soldering processes often are used, and the heat involved in such processes causes thermal expansion of the metal shell, which results in a widening of the gap between the opposed ends at the joint.

In order to prevent the opposed ends of the shell from widening at the joint, the opposed ends may be fixed, as by spot welding. Unfortunately, this inherently requires an additional processing step which significantly increases the cost of the connector.

Another problem with metal shells which have opposed ends that overlap at a joint, is that the overlapped ends increase the thickness of the shell at the joint. In other words, two overlapped ends double the thickness of the metal shell to create a bulged portion which is undesirable in many applications. For instance, the joint in a sheet metal shell typically is located at the bottom of the connector. If the connector is to be surface mounted on a printed circuit board, the bulged joint creates an uneven surface and prevents the bottom of the connector from being coplanar with the surface of the circuit board.

The present invention is directed to solving the various problems identified above by providing a joint between the opposed ends of a metal shell which is the same thickness as the metal material forming the shell and which fixes the joint without extraneous processing such as welding.

SUMMARY OF THE INVENTION

An object, therefore, of the invention is to provide a new and improved joint in a metal shell of an electrical connector.

In the exemplary embodiment of the invention, the connector includes an insulative housing having a plurality of terminals mounted therein. A metal shell is disposed about at least a portion of the housing. The shell has a given thickness and opposed ends forming a joint. The opposed ends are overlapped at the joint. Each overlapped end has a reduced thickness less than the given thickness of the metal shell.

As disclosed herein, the metal shell is an endless annular structure fabricated of sheet metal material and joined at the overlapped joint. The opposed ends have stepped configurations to define the reduced thicknesses thereof. Preferably, the combined thickness of the overlapped ends is substantially equal to the given thickness of the sheet metal material.

Other features of the invention include a filler material between the overlapped opposed ends of the metal shell. In addition or alternatively, the overlapped ends can be fixed by a pin on one of the ends projecting into a hole in the opposite overlapped end. The pin may be staked or crushed in the hole.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
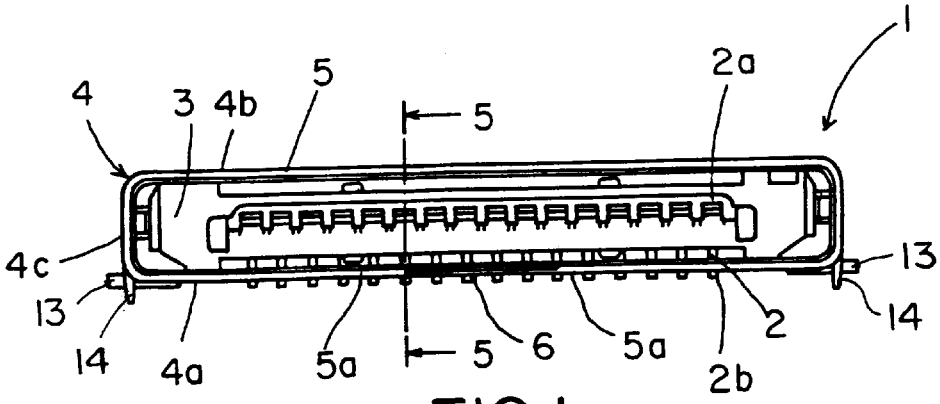
FIG. 1 is a front elevational view of an electrical connector embodying the concepts of the invention.
Figure 2:
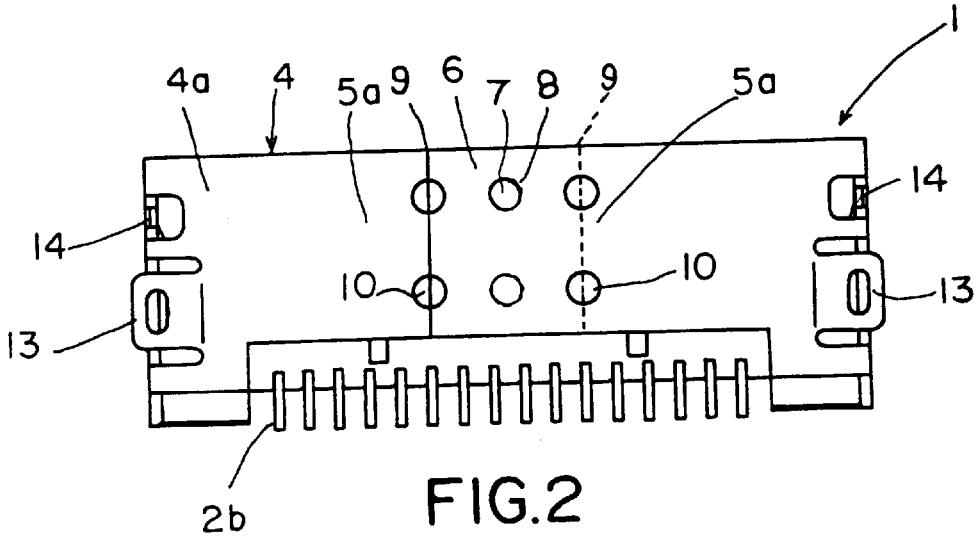
FIG. 2 is a bottom plan view of the connector.
Figure 3:
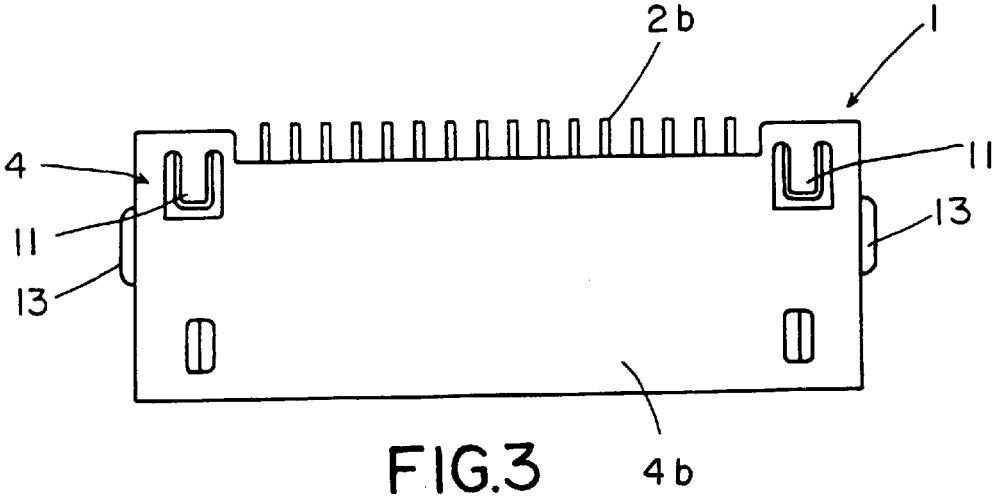
FIG. 3 is a top plan view of the connector.
Figure 4:
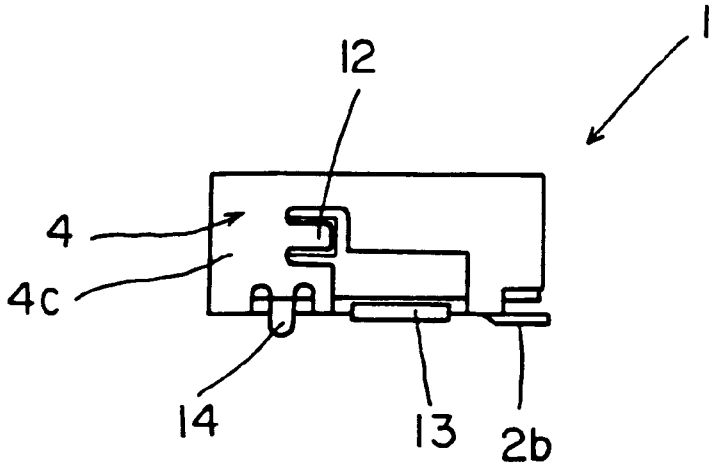
FIG. 4 is a side elevational view of the connector.

Referring to the drawings in greater detail, and first to FIGS. 1–5, the invention is embodied in an electrical connector, generally designated 1, which includes a plurality of terminals 2 (FIG. 5) arranged in a generally parallel, spaced array within an insulative housing 3. A metal shell, generally designated 4, is disposed about the outer periphery of insulative housing 3.

Figure 5:
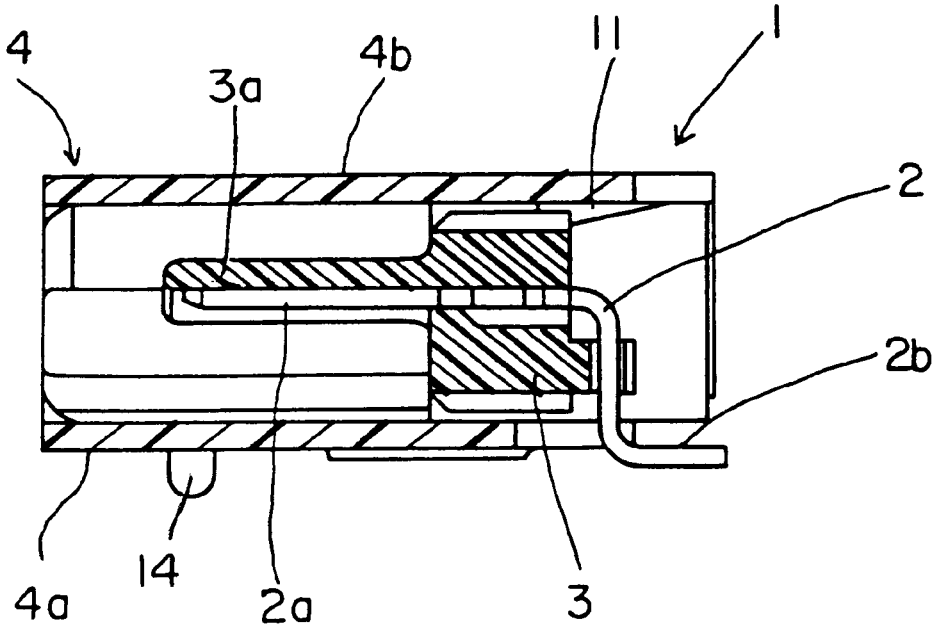
FIG. 5 is an enlarged section taken generally along line 5—5 of FIG. 1.

As seen best in FIG. 5, each terminal 2 includes a pin-type contact portion 2*a* for engagement with a counterpart terminal of a complementary mating electrical connector (not shown). The contact portion is juxtaposed on a mating end 3*a* of housing 3 which is engaged within a receptacle of the complementary mating connector. Each terminal 2 also has a solder tail portion 2*b* projecting rearwardly of housing 3. The tail portion is bent in substantially an L-shaped configuration so that the bottom of the tail portion lies substantially flush with the bottom of metal shell 4 for surface connection, as by soldering, to an appropriate circuit trace on a printed circuit board.

Metal shell 4 is fabricated of stamped and formed sheet metal material and is formed, generally, into a quadrangular tubular configuration. In essence, the metal shell can be considered to have been stamped and formed from a metal plate 5 to define a top wall 4*b* and depending side walls 4*c* about the top and sides of housing 3. The metal material is bent from side walls 4*c* inwardly to define a bottom wall 4*a*. Opposed ends 5*a* of the metal material are overlapped at a joint 6. The metal shell 4 is thereby formed into an endless tubular configuration with top wall 4*b*, side walls 4*c* and bottom wall 4*a* substantially entirely covering the periphery of insulative housing 3. Joint 6 formed in bottom wall 4*a* is defined by opposed ends 5*a* being overlapped with each other and providing a joint of substantially the same thickness as that of the other sheet metal material of the shell, as described below.

Figure 6:
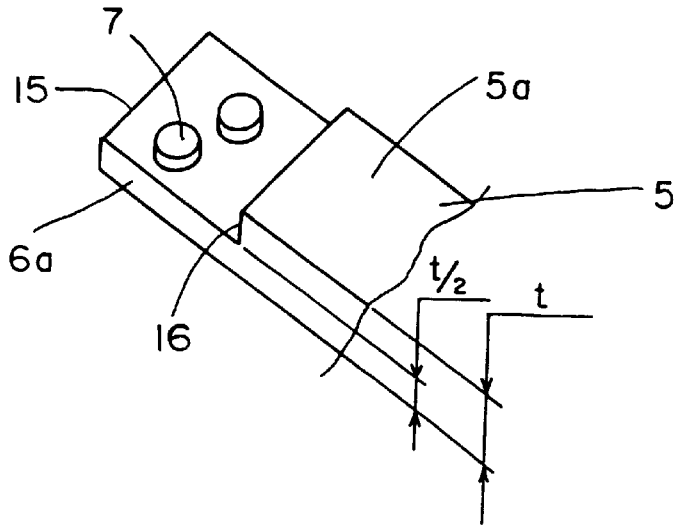
FIG. 6 is a perspective view of one of the opposed ends of the overlapped shell.
Figure 7:
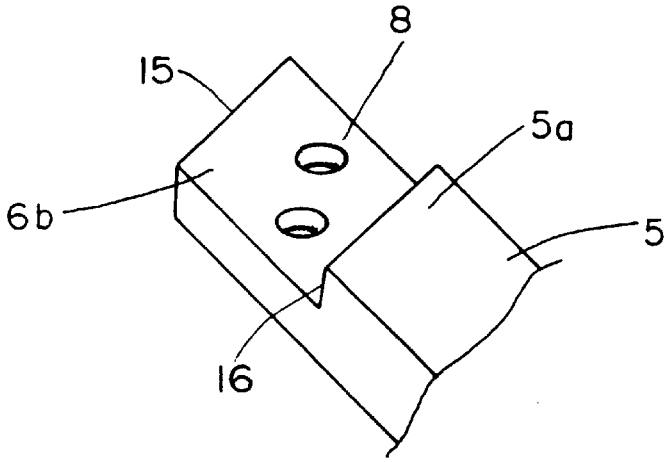
FIG. 7 is a perspective view of the opposite overlapped end of the shell.
Figure 8:
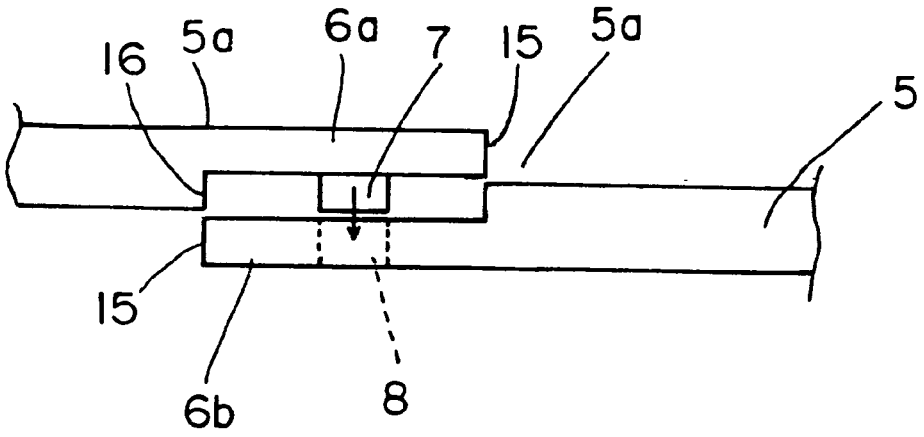
FIG. 8 is an elevational view of the overlapped ends just prior to being fixed together.

Referring next to FIGS. 6–9, one end 5*a* of the sheet metal material 5 of shell 4 is stepped into a one-half thickness of the thickness "t" of the sheet metal material by press-forming to define a first opposed, joining end 6*a* (FIG. 6). The other end 5*a* of the metal material 5 also is stepped into a one-half thickness of the thickness "t" of the metal material 5 by press-forming to define a second opposed, joining end 6*b* (FIG. 7). These joining ends 6*a* and 6*b* are overlapped for joining as shown in FIG. 8. Therefore, joint 6 has substantially the same thickness as the metal material 5 of shell 4 when the first and second ends 6*a* and 6*b* are overlapped and joined.

FIG. 6 shows that one or more projecting portions or pins 7 are formed on the inside of the first joining end 6*a* during the press-forming operation. FIG. 7 shows that one or more holes 8 are formed in the second joining end 6*b*, again during the press-forming operation. Holes 8 are aligned with holes 8 when joining ends 6*a* and 6*b* are properly overlapped. Upon complete joining of the first and second joining ends 6*a* and 6*b*, as by compressing the ends generally perpendicular to the sheet metal material, pins 7 enter holes 8 to fix the joined ends at joint 6. With sufficient pressure, the gap between joining ends 6*a* and 6*b* can be made as small as possible.

Figure 10:
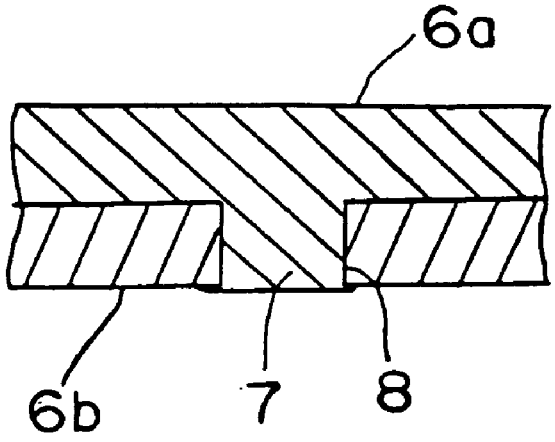
FIG. 10 is a section through one embodiment of the pin connection between the overlapped ends.

FIG. 10 shows that the one or more pins 7 can be made slightly longer than the depth of holes 8. During the pressure joining process, the tips of the pins can be staked or crushed over the circumferential edges of holes 8 as seen in FIG. 10 to lock opposed ends 6*a* and 6*b* together.

Figure 11:
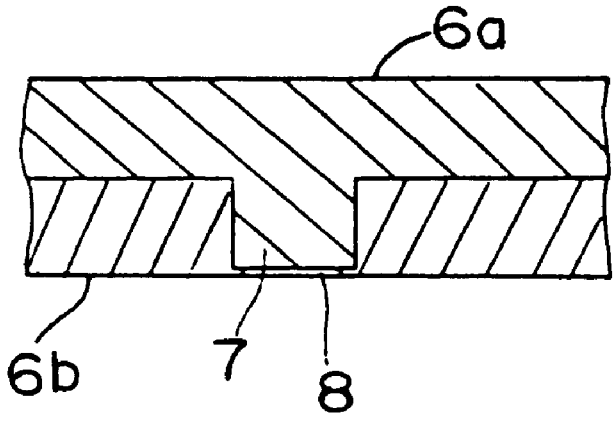
FIG. 11 is a section through another embodiment of the pin connection.

FIG. 11 shows an alternate embodiment wherein the depth of holes 8 is slightly greater than the lengths of pins 7. During the pressure joining process, the edges of the holes can be staked or crushed to extend over the tips of the pins as shown in FIG. 11 to completely seal the holes.

Figure 9:
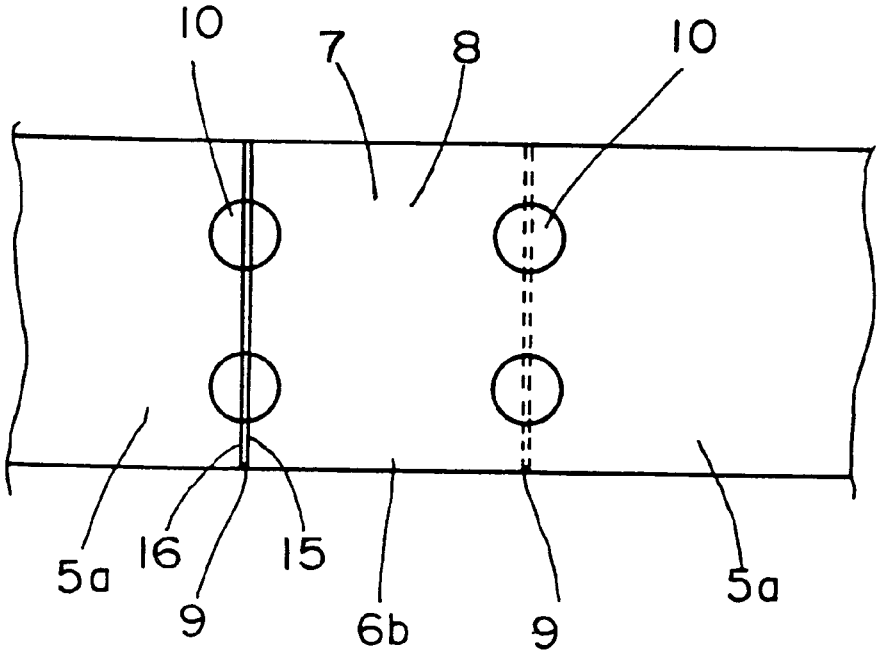
FIG. 9 is a plan view of the overlapped ends.

In an alternative embodiment, as seen in FIG. 9, areas 10 may be compressed under high pressure at gaps 9 between the opposed ends 5*a* of the shell. These compressed areas also may be replaced by a filler material to fill the gaps.

Referring back to FIGS. 1–5, top wall 4*b* of metal shell 4 includes a pair of cantilevered engaging tabs 11 which are formed inwardly toward the housing. Side walls 4*c* of the shell have cantilevered, inwardly directed tabs 12. These tabs 11 and 12 engage the outer periphery of insulative housing 3 when the metal shell is assembled about the housing. Since the tabs 11 and 12 are cantilevered in mutually opposite directions to bear forces in opposite directions, relative movement between the shell and the housing is prevented when fully assembled. Solder legs 13 are formed in bottom wall 4*a* of the shell for surface connection, as by soldering, to pads on the printed circuit board, such as soldering the shell to ground traces on the board. Finally, a pair of positioning posts 14 are formed integrally with the shell and project downwardly therefrom for insertion into appropriate mounting holes in the circuit board.

Upon mounting of electrical connector 1 on a surface of a printed circuit board (not shown), positioning posts 14 first are inserted into the mounting holes in the board. Then, solder tail portions 2*b* of the terminals are connected to the circuit traces on the printed circuit board by a reflow soldering process. Simultaneously, solder legs 13 are soldered to their solder pads on the circuit board. During the soldering processes, insulative housing 3 is subjected to high temperatures to cause thermal expansion. However, since metal shell 4 has a top wall 4*b*, side walls 4*c* and a bottom wall 4*a* which are secured at joint 6 to substantially entirely surround the housing, thermal expansion is resisted and effectively restricted against the stress generated by thermal expansion of the insulative housing. Therefore, displacement of solder tail portions 2*b* and solder legs 13 relative to the printed circuit board is substantially prevented.

In addition, since joint 6 of metal shell 4 has substantially the same thickness as the remainder of the shell (i.e. sheet metal material 5), a bulge is not created at the bottom of the connector. Therefore, the metal shell can be tightly fitted over the entire surface areas of the insulative housing. In addition, bottom wall 4*a* of the metal shell can be tightly fitted onto the top surface of the printed circuit board. Furthermore, since gaps are eliminated in the shell, EMI leakage is minimized and the ingress of gas vapors and dust into the electrical connector also is minimized.

In the fabrication of metal shell 4, stamping the sheet metal material 5, press forming stepped ends 6*a* and 6*b*, forming engaging tabs 11 and 12 along with solder legs 13 and positioning posts 14, forming the sheet metal material into the quadrangular tubular configuration, and forming joint 6 by overlapping ends 6*a* and 6*b*, all are done by punching and forming of the metal plate material. Therefore, the metal shell can be progressed in a sequential process through an appropriate press die.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

an insulative housing;

a plurality of terminals mounted on the housing;

a metal shell about at least a portion of the housing, the shell having a given thickness and opposed ends forming a joint, the opposed ends being overlapped at the joint, and each overlapped end having a reduced thickness less than said given thickness of the metal shell and a pin extending from and integrally formed with one of the overlapped ends of the metal shell protecting into a hole in the opposite overlapped end.

2. The electrical connector of claim 1 wherein said metal shell is fabricated of sheet metal material.

3. The electrical connector of claim 1 wherein said metal shell is an endless annular structure joined at said joint.

4. The electrical connector of claim 1 wherein said opposed ends have stepped configurations to define said reduced thicknesses thereof.

5. The electrical connector of claim 1 wherein the combined thickness of said overlapped ends is substantially equal to said given thickness.

6. The electrical connector of claim 5 wherein said opposed ends have stepped configurations to define said reduced thicknesses thereof.

7. The electrical connector of claim 1, including a filler material between the overlapped opposed ends of the metal shell.

8. The electrical connector of claim 1, including compressed portions between the overlapped opposed ends of the metal shell.

9. The electrical connector of claim 1 wherein said pin is staked in said hole.

10. An electrical connector, comprising:

an insulative housing;

a plurality of terminals mounted on the housing;

a metal shell about at least a portion of the housing, the shell being stamped and formed of sheet metal material of a given thickness and having opposed ends forming a joint, the opposed ends being overlapped at the joint, and each overlapped end having a stepped configuration to define a reduced thickness less than said given thickness of the metal shell, with the combined thickness of the overlapped ends being substantially equal to said given thickness; and a pin extending from and integrally formed with one of the overlapped ends of the metal shell projecting into a hole in the opposite overlapped end.

11. The electrical connector of claim 10 wherein said metal shell is an endless annular structure joined at said joint.

12. The electrical connector of claim 10, including a filler material between the overlapped opposed ends of the metal shell.

13. The electrical connector of claim 10, Including compressed portions between the overlapped opposed ends of the metal shell.

14. The electrical connector of claim 11 wherein said pin is staked in said hole.

15. The electrical connector of claim 10 wherein edges of said hole are staked about a tip of the pin.

16. An electrical connector, comprising:

an insulative housing;

a plurality of terminals mounted on the housing;

a metal shell about at least a portion of the housing, the shell having opposed ends forming a joint, the opposed ends being overlapped at the joint; and a pin extending from and integrally formed with one of the overlapped ends of the metal shell projecting into a hole in the opposite overlapped end.

17. The electrical connector of claim 16 wherein said pin is staked in said hole.

* * * * *